US006498549B1

(12) United States Patent
Jiang et al.

(10) Patent No.: US 6,498,549 B1
(45) Date of Patent: Dec. 24, 2002

(54) DUAL-TUNING MICROWAVE DEVICES USING FERROELECTRIC/FERRITE LAYERS

(75) Inventors: Hua Jiang, Mansfield, MA (US); Wei Hu, Cambridge, MA (US); Shaohua Liang, Somerset, NJ (US); Yi-Qun Li, Orinda, CA (US); Vladimir Fuflyigin, Winchester, MA (US); Jiankang Huang, Cambridge, MA (US)

(73) Assignee: Corning Applied Technologies Corporation, Woburn, MA (US)

( * ) Notice: Subject to any disclaimer, the term of this patent is extended or adjusted under 35 U.S.C. 154(b) by 0 days.

(21) Appl. No.: 09/457,430

(22) Filed: Dec. 7, 1999

Related U.S. Application Data

(60) Provisional application No. 60/111,265, filed on Dec. 7, 1998.

(51) Int. Cl.[7] ..... H01P 1/20; H01P 1/18

(52) U.S. Cl. ..... 333/202; 333/156; 333/161

(58) Field of Search ..... 333/202, 156, 333/161

(56) References Cited

U.S. PATENT DOCUMENTS

| | | | | |
|---|---|---|---|---|
| 3,661,241 A | | 5/1972 | Ioffe et al. | 198/33 |
| 5,309,166 A | | 5/1994 | Collier et al. | 343/778 |
| 5,484,765 A | | 1/1996 | Dionne et al. | 505/210 |
| 5,496,795 A | | 3/1996 | Das | 505/210 |
| 5,512,196 A | | 4/1996 | Mantese et al. | 252/62.9 |
| 5,589,845 A | | 12/1996 | Yandrofski et al. | 343/909 |
| 5,601,748 A | | 2/1997 | Mansour et al. | 252/62.9 |
| 5,635,453 A | | 6/1997 | Pique et al. | 505/239 |
| 5,650,378 A | | 7/1997 | Iijima et al. | 505/473 |
| 5,694,134 A | | 12/1997 | Barnes | 343/700 |
| 5,703,020 A | | 12/1997 | Das | 505/210 |
| 6,097,263 A | * | 8/2000 | Mueller et al. | 333/17.1 |
| 6,265,353 B1 | * | 7/2001 | Kinder et al. | 505/238 |

FOREIGN PATENT DOCUMENTS

| | | |
|---|---|---|
| GB | 2194685 | 3/1988 |
| JP | 07245224 | 9/1995 |
| WO | WO 99/66584 | 12/1999 |

OTHER PUBLICATIONS

Jia, Q.X., et al., "Integration of Nonlinear Dielectric Barium Strontium Titanate with Polycrystalline Yttrium Iron Garnet," *Applied Physics Letters*, 74 (11) 1564–1566 (1999).

Chen, K.Y., et al., "Improvement of In–plane Alignment of $YBa_2Cu_3O_{7-x}$ Films on Polycrystalline Alumina Substrates Using Biaxially Aligned $CeO_2$/YSZ Buffer Layers," *Physica C* 282–287:613–614 (1997).

Jiang, H., "Low Loss Ferroelectric Films Grown on Polycrystalline Ferrite Substrates for Dual–Tuning Microwave Devices," *Mat. Res. Soc. Symp. Proc.*, 574:311–316 (1999).

(List continued on next page.)

*Primary Examiner*—Patricia Nguyen
(74) *Attorney, Agent, or Firm*—Hamilton, Brook, Smith & Reynolds, P.C.

(57) ABSTRACT

A ferroelectric layer is deposited or in close proximity to a ferromagnetic ferrite layer to make a microwave substrate on which conductors can be deposited or placed to make devices. The permittivity of the ferroelectric layer can be changed by applying a voltage and the permeability of the ferromagnetic layer can be changed with a magnetic field. This makes it possible to tune the device characteristics with two different effects taking best advantage of the capabilities of each. A material example is ferromagnetic yttrium-iron-garnet on which is deposited a thin film of ferroelectric barium strontium titanate. To minimize losses, the ferroelectric film should be high quality, but practical yttrium-iron-garnet substrates are polycrystalline so that the use of buffer layers is desirable. At least two methods can be used to deposit the ferroelectric film, pulsed laser deposition and metal-organic chemical liquid deposition. A variety of dual tunable microwave devices can be made with this substrate, including by way of example only, phase shifters, frequency filters, and resonators.

19 Claims, 12 Drawing Sheets-

OTHER PUBLICATIONS

Demidov, V.E., and Kalinikos, B.A., "Electrical Tuning of the Dispersion Characteristics of Spin Waves in Metal–ferroelectric–ferrite–ferroelectric–metal Structures," *Technical Physics Letters*, 25 (11) :880–883 (1999).

J. D. Adam, "an MSW Tunable Bandpass Filter,"IEEE 1985 Ultrasonics Symposium, pp. 157–162.

K. K. Li et al., "An Automatic Dip Coating Process for Thin and Thick Films," Integrated Ferroelectrics, vol. 3, Gordon and Breach Science Publishers S.A., 1993, pp. 81–91.

A. M. Hermann et al., "Oxide Superconductors and Ferroelectrics—Materails for a New Generation of Tunable Micrwave Devices," J. Superconductivity, vol. 7, No. 2, 1994, pp. 463–469.

Gerals F. Dionne et al., "YBCO/Ferrite Low–Loss Microwave Phase Shifter," IEEE Trans. Appl. Supercond., vol. 5, No. 2, Jun. 1995, pp. 2083–2086.

Jack W. Judy et al., "Batch–Fabricated, Addressable, Magnetically Actuated Microstructures," Technical Digest Solid Stated Sensor and Actuator Workshop, Hilton Head, SC, 1996, pp. 197–190.

Spartak S. Gevorgian et al., "CAD Models for Multilayered Suubstrate Interdigital Capacitors," IEEE Trans. Microwave Theory Tech., vol. 44, No. 6, Jun. 1966, pp. 896–904.

R. Kalyanaraman et al, "Influence of oxygen background pressure on crystalline quality of SrTiO3 films grown on MgO by pulsed laser deposition." Appl. Phys. Lett., vol. 71, No. 12, Sep. 22, 1997, pp. 1709–1711.

C. P. Wang et al., "Deposition of in–plane textured mgO on amorphous Si3N4 substrates by ion–beam–assisted deposition with ion–beam–assisted deposited yttria–stabilized zirconia," Appl. Phys. Lett., vol. 71, No. 20, Nov. 17, 1997, pp. 2955–2957.

F.A. Miranda et al. "Tunable Microwave Components for Ku– and K–Band Satellite Comunications," NASA/TM—1998–206963, May 1998, pp. 1–10.

* cited by examiner

DUAL-TUNING MICROWAVE DEVICES USING FERROELECTRIC/FERRITE LAYERS

RELATED APPLICATIONS

This application claims priority from provisional application serial No. 60/111,265, filed on Dec. 7, 1998 and incorporated herein by reference.

STATEMENT OF GOVERNMENT SUPPORT

This invention was made with Government support under contract nos. NAS3-98067 and NAS3-99110, awarded by the National Aeronautics and Space Administration. The Government has certain rights in this invention.

BACKGROUND

1. Technical field

This invention is in the general field of microwave devices and, more particularly, devices having at least an electrically tunable ferroelectric layer and at least a magnetically tunable ferromagnetic layer in close proximity.

2. Background

The microwave region of the spectrum ranges very approximately from 1 to 300 GHz with wavelengths of 30 cm to 1 mm, respectively. Most applications use frequencies of less than 50 GHz. In general terms, most microwave devices comprise two or more conductors on, enclosing, or enclosed by non-conductive media. One characteristic of the media is the propagation constant, β, given by:

$$\beta=\omega(\in_d\mu_o\in_e\mu_e)^{1/2} \qquad \text{Equation (1)}$$

where ω is the radian frequency and $\in_e$ and $\mu_e$ are the effective dielectric constant and permeability of the media, respectively. (For air, $\in_e,=\mu_e=1$). Microwaves traveling along a transmission line experience a delay, usually expressed as a propagation phase difference given by:

$$\phi=\beta l=\omega l(\in_d\mu_o\in_d\mu_e)^{1/2}(\text{radians})=360(l/\lambda)(\in_d\mu_e)^{1/2}(\text{degrees}) \qquad \text{Equation (2)}$$

where l is the effective distance between the two points and λ is the free-space wavelength. Thus, changing or tuning any of l, $\in_e$ or $\mu_e$ changes the phase difference. However, in principle, any delay line configuration can also be viewed as a frequency filter structure providing low insertion loss in pass bands and high attenuation in stop bands. Fundamentally, a phase shifter or filter can be viewed as the same device with emphasis on different physical quantities (governed by the propagation constant β). The most useful tunable microwave devices are phase shifters, resonators, and frequency filters.

Conventional microwave tuning is predominantly achieved via changing the physical is dimension with tuning screws, tuning plungers, sliding conductors or sliding walls. Typically, the transmission line is a hollow rectangular waveguide. Mechanical tuning, however, has the major drawbacks of bulkiness, inconvenient operation, and low tuning speed.

Microwave transmission lines can be made on circuit boards. G-10 epoxy ($\in_e$=10, $\mu_e$=1) is useful to 1.5 GHz, where it becomes too lossy, and Teflon® ($\in_e$=2.3, $\mu_e$=1) at higher frequencies. Typically, the transmission line consists of a ground plane on one side and strip conductors on the other. However, if the dielectric constant is high enough, coplanar conductors on one side only, can be used. This is because the electric fields will be concentrated in the substrate. A mixture of Teflon® and ceramic powders produce an $\in_e$=10. Devices are constructed with components including active monolithic microwave integrated circuits (MMICs) connected by such transmission lines. Tuneable oscillators can be constructed with yttrium iron garnet (YIG) spheres or barium titanate (BTO) cylinders placed in close proximity to the transmission line. These produce a resonance in a circuit whose center frequency can be shifted by application of an external magnetic or electric field, respectively. See *Handbook of Microwave and Optical Components*, Vol. 1, K. Chang, ed., Wiley Interscience (1997), incorporated herein by reference, for background material on traditional microwave devices.

Microwaves are used for both communications and radar. In both, but especially for radar, the beam direction can be steered by using a two dimensional array of phase shifters. For some applications, several thousand are required and there is an incentive to make the shifters as compact as possible. One solution, ca. 1980, uses YIG as the medium in contact with a coplanar transmission line. The permeability, μ, of YIG ($\in_e$=15, $\mu_e$=on the order of 1,000) can be varied by the application of an external magnetic field, H, because $\mu_e$ is non-linear with H. Therefore, the phase shift of the RF wave can be varied according to Equation 2. Single crystals of YIG are available, but only in small sizes at great cost. However, polycrystalline YIG can be used with low loses even at high power levels. Also, its properties can be varied by changing the chemical composition. It is the preferred technologically important material for many microwave applications.

In the last decade, similar microwave devices based on varying the permittivity, ∈, of a ferroelectric substrate using a voltage between the transmission line conductors have been proposed. The technological material of choice appears to be $Ba_xSr_{1-x}TiO_3$ (BST) (x=0 to 1) ($\in_e$=on the order of 1000, $\mu_e$=1). The advantages of using BST for tunable microwave applications are its low loss and high tunability, i.e., variation of permittivity with voltage. Tunability is maximized when the material is operated near its Curie temperature. For BST, this can be adjusted by changing the Ba concentration, x. For example, at least for bulk BST, it ranges from 30 K to 400 K for Ba concentrations ranging from x=0 to 1, respectively. The ability to control the dielectric properties of BST in a simple way allows device structures to be easily optimized for maximum tunability and minimum loss at the desired frequency and operating temperature. In addition, for rapid tuning, it is generally easier to provide rapidly changing electric fields than magnetic ones.

Individually, each approach, ferromagnetic or ferroelectric, has limitations. In a phase shifter, ferromagnetic tuning is limited to frequencies less than the ferromagnetic resonance frequency. Ferroelectric tuning is limited by voltage breakdown. For a phase shifter, arbitrarily large phase changes can be obtained by making the transmission line arbitrarily long, but large sizes are generally not desirable. A structure that combined both approaches would have the advantage of producing additional phase shift for the same length. A non phase-shifter example is a multi-element filter where the center frequency, passband, and ripple are determined in a complicated but well known way by conductor geometries and the propagation constant, β. The filter characteristics can be changed by changing β. Providing a separate magnetic field for each element would be inconvenient, but a purely electrical device may not provide enough change in β. Using dual tuning, the magnetic field could provide the broadband tuning of the filter bandpass while electric tuning for each element would allow fine tuning of the filter profile to achieve symmetric and optimum filter characteristics.

One of the problems with electrical or magnetically tunable devices is that the transmission line impedance also changes. Even though initially connected to a matching impedance, changes will introduce unwanted reflections. The impedance is given by:

$$Z\ (\mu_e/\in_e)^{1/2} \qquad \text{Equation (3)}$$

with the proportionality being determined by geometrical factors. For most devices, it would be a large advantage to maintain a constant ratio between $\mu_e$ and $\in_e$ and therefore a constant Z.

One application where a dual tuning capability would be most advantageous is for phased-array antennas, see U.S. Pat. Nos. 5,309,166 and 5,589,845, incorporated herein by reference, for ferroelectric only versions. Magnetic fields that are difficult to apply to individual elements could be used for overall steering and electric fields for fine tuning each element. In this application, the slower magnetic tuning could be used for gross adjustment and the faster electric tuning for fine adjustment.

Using a material that has the properties of both might seem obvious. Such materials, e.g., europium barium titanate, have been known to exist for a long time. They are, however, not very sensitive to either electric or magnetic fields. Ferroelectric-ferromagnetic composites are also known and have been used to filter out high frequency electromagnetic interference in feed through connectors. The composites are made by sintering fine grain (0.1 um to 1.0 um) oxide powders. However, it is believed that the change in permitivity of the ferroelectric material with an applied electric field would be very low. Thus, no single material having the properties of both has been used for microwave devices. Moreover, no composite material microwave substrate has been produced combining both voltage and magnetic tuning capabilities.

SUMMARY

Accordingly the main object of the invention is to provide a dual tunable microwave substrate comprising practical ferroelectric and ferromagnetic material so that those skilled in the art can use the substrate in various geometrical configurations to build phase shifters, delay lines, resonators, oscillators, directional couplers, filters, various antennas, and other microwave and millimeter wave devices that can be controlled or tuned by application of a voltage and/or magnetic field.

A further object of the invention is to provide a dual tunable microwave substrate whose propagation constant can be controlled while maintaining a relatively constant transmission line impedance.

These objectives are realized by depositing a ferroelectric thin film on a ferromagnetic substrate. High quality ferroelectric films are produced by using one or more intermediate layers as buffers for epitaxial growth. One example uses a yttrium iron garnet substrate with a buffer layer of yttrium stabilized zirconia and barium strontium titanate as the ferroelectric thin film. Another example uses buffer layers comprising silicon nitride followed by magnesium oxide. Pulsed laser deposition or a metal-organic chemical liquid deposition process which is novel with respect to the ferroelectric films can be used to deposit them.

An example of a microwave device is a phase shifter constructed by depositing coplanar gold electrodes on the ferroelectric thin film. A two dimensional array of these can be used to construct a phased array antenna. Other examples are frequency filters and resonators. Performance of all devices can be improved by using high temperature superconductors as coplanar electrodes. A microminiature magnetic field generator is useful in some applications.

DETAILED DESCRIPTION

The main object of the invention was realized by depositing high quality biaxially oriented BST thin films on polycrystalline YIG substrates using two different buffer layers. Prototype phase shifters were constructed as one of many possible working embodiments. BST films grown on a YSZ buffer layer deposited on polycrystalline YIG:

The material used as the YIG substrate was type G-113 purchased from Trans-Tech, Adamstown, Md. The physical properties of G113 are listed in the table below.

| | |
|---|---|
| Chemical Formula | $Y_3Fe_5O_{12}$ |
| Saturation Magnetization $4\pi M_S$ | 1.78 kG |
| Lande g-Factor g-eff | 1.97 |
| Line Width $\Delta H$ | <30 Oe |
| Dielectric Constant $\epsilon'$ | 15 |
| Dielectric loss, Tan $\delta = \epsilon''/\epsilon'$ | <0.0002 |
| Curie Temperature $T_C$ | 280° C. |
| Spine wave line width $\Delta H_k$ (Oe) | 1.43 Oe |
| Remanent Induction $B_r$ | 1.277 kG |
| Coercive force $H_c$ | 0.45 Oe |
| Initial Permeability $\mu_0$ | 1.34 |
| Thermal expansion coefficient | 8 $\mu$m/m/° C. |
| Size: | 2 cm × 2 cm × 1.5 mm |

As received, substrates were not flat and the surface roughness was about 150 nm. The YIG substrate was further mechanically polished using a diamond grit to about a 50 nm centerline average roughness, as measured by a laser profilometer, with a resulting 1 mm thickness. In retrospect, in spite of buffer layers, it is now believed that further polishing of the YIG substrate would be beneficial. (Polycrystalline YIG substrates with a 5 nm roughness were obtained from Keon Optics, Inc., Haverstraw, N.Y., but not in time to be used.) After polishing, samples were sent to Los Alamos Laboratory, Los Alamos, N. Mex. This entity was a subcontractor of the assignee of the present invention working under the direction of the present inventors. All work at Los Alamos used processes known for other materials to deposit films used in the invention. In particular, Los Alamos used an Ion Beam Assisted Deposition (IBAD) process to deposit YSZ on the YIG substrate. The IBAD process as applied to polycrystalline metal substrates is described in detail in U.S. Pat. No. 5,650,378, issued Jul. 22, 1997 to Iijima et al., incorporated herein by reference.

Figure 1:
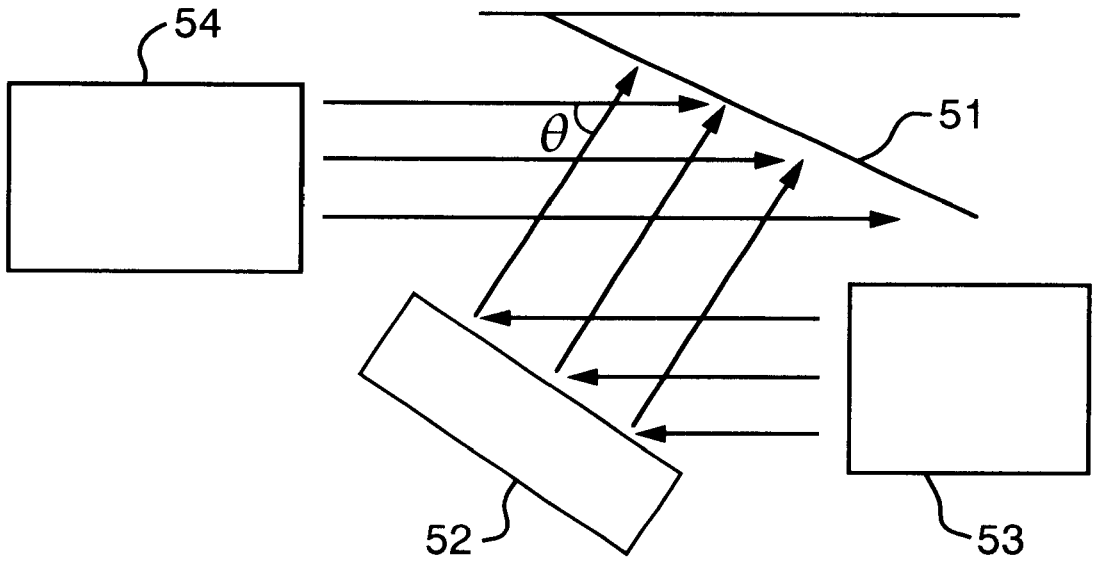
FIG. 1 (PRIOR ART)
FIG. 1 illustrates an ion-beam-assisted deposition (IBAD) apparatus.

FIG. 1 illustrates the apparatus. The process uses two ion guns, 53 and 54. Basically, these are cylinders with a gas inlet and hot filament at one end and a screen-type electrode at the other. The filament produces energetic electrons that ionize the usually inert gas and the screen electrode accelerates the ions out of the other end of the gun. One gun, the sputter gun 53 is directed, at an angle of about 45°, toward a target plate composed of the material that is to be sputter deposited on a substrate. The ions from the sputter gun must have enough energy to eject material from the target plate 52. The other gun, the assist gun 54 is directed toward the substrate 51. It is believed that the effect of the assist gun is to preferentially sputter off layers growing with certain crystallographic orientations leaving crystallites with one desired orientation. Another effect is that the crystallites films are biaxially textured, that is, the in-plane orientations are approximately aligned over the substrate surface even though the underlying substrate is polycrystalline or even amorphous. A critical parameter is the angle of the assist gun, $\theta$, with respect to the substrate.

In order to promote epitaxial growth, it is desirable that the lattice size of the buffer layer match the BST lattice. At optimum growth temperatures, BST is cubic with a lattice size of 3.91 to 3.99 Å, depending on x, and grows preferentially with either a (100) or (110) orientation. YSZ has a lattice size of 5.96 Å and on a room temperature (RT) substrate has two preferential growth orientations, (111) and (100). The (111) YSZ orientation does not match any BST orientation, but YSZ's (100) orientation would produce a match to BST growing with a (110) orientation. Accordingly, $\theta$ is set to 54.7° which is normal to the (111) plane of any growing YSZ film and would be preferentially sputtered off.

For YSZ deposition, the sputter target was composed of a zirconia ($Zr_2O_3$) polycrystalline ceramic with a 10 atomic % admixture of $Y_2O_3$. An ion gun with a beam diameter of 5 cm was used for the sputter gun and a beam diameter of 2.5 cm was used for the assist gun, both from Ion Tech, Inc., Fort Collins, Colo. The sputter gun was operated at 550 V and 300 mA of total beam current, while the assist gun was operated at 250 V and 150 uA/cm$^2$ as measured by a Faraday cup. Both used argon as the ion. A total pressure of $1\times10^{-4}$ torr was maintained but $O_2$ was introduced to a partial pressure of $1.5–2.5\times10^{-6}$ torr. Under these conditions, the deposition rate, as determined by a quartz crystal oscillator, of YSZ films on the YIG substrate was about 250 nm/min. Samples with a total YSZ film thicknesses of about 500 nm were grown.

Figure 2:
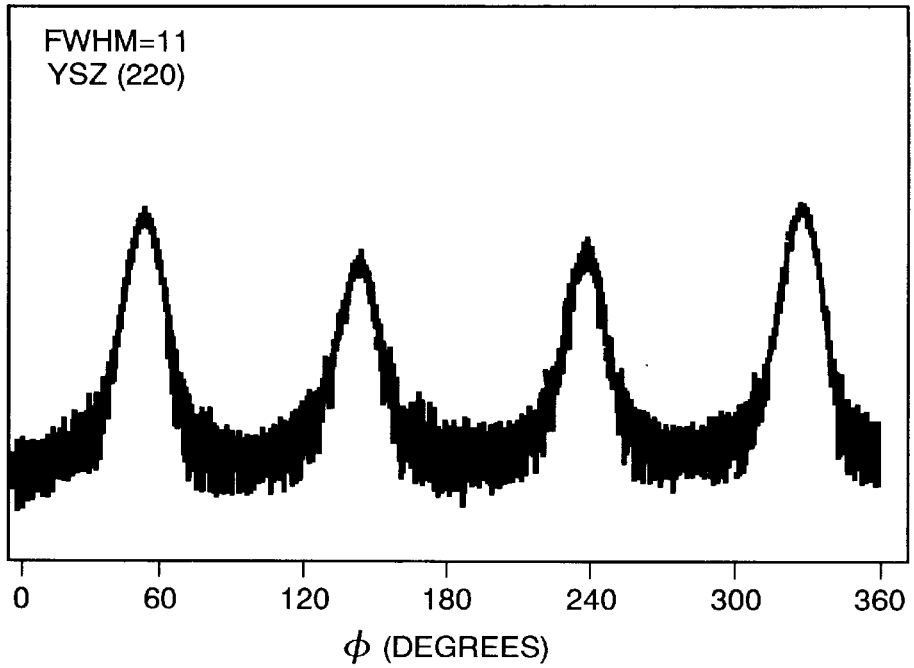
FIG. 2 shows an X-ray diffraction $\phi$ scan on the (220) orientation of YSZ deposited on polycrystalline YIG.

FIG. 2 shows the results of an X-ray diffraction $\phi$ scan at every 90° on the (220) orientation of the YSZ layers. The full width at half maximum intensity (FWHM) is 11°, indicating substantial ordering of the crystallites.

$Ba_{0.5}Sr_{0.5}TiO_3$, in its bulk form, has a Curie temperature near room temperature, and $Ba_{0.6}Sr_{0.4}TiO_3$ has one slightly above. (However, it is known that the Curie temperature of thin films is about 50 K less than the corresponding bulk composition.) These composition thin films were grown on the YSZ layers using metal-organic chemical liquid deposition (MOCLD). The MOCLD technique, as applied to lead lanthanum zirconate titanate (PLZT), is well known, see K. K. Li et al., "An Automatic Dip Coating Process for Dielectric Thin and Thick Films," Integrated Ferroelectrics, Vol. 3, pp. 81–91 (1993), incorporated herein by reference, but the growth of BST on YSZ had not been done.

Growth was undertaken using an apparatus as identical as possible to that described in the reference. The one constructed consisted of a 45-cm long vertical tube furnace positioned about 12 cm above a solution container inside a dipping chamber. The dipping chamber was at ambient since the solutions are resistant to hydrolyzation. A substrate holder was connected to a chromel wire that passed through the tube furnace and a small hole in a cap at the top and then to a computer controlled pulling motor.

The process consists of four steps repeated until a desired thickness is achieved. The steps consist of dipping into the solution at a dip rate, holding for a coating time, pulling out of the solution at a removal rate, holding in the chamber below the furnace for a drying time, pulling into the middle of the furnace at a pull rate, holding for a firing time, descending out the bottom at a descend rate and holding in the dipping chamber for a cool down time. A typical set of step parameters consists of:

| | | Rate (mm/s) | Hold Time (seconds) |
|---|---|---|---|
| 1. | Dip and Coat: | 1–5 | 0 |
| 2. | Remove and Dry: | 1–3 | 0 |
| 3. | Pull and Fire: | 1–3 | 120–300 |
| 4. | Descend and Cool: | 1–3 | 60–120 |

Even with no hold times, at these rates, it took about 24 to 120 seconds to travel up to the bottom of the tube furnace (which was sufficient for drying), and 75 to 225 seconds to travel into or out of the middle of the tube furnace. The coating thickness primarily depends on the substrate velocity through the solution and, typically, no extra coating time is used. The organics used are carboxylates and alkoxides. During firing, these are converted to carbonates that are converted to a crystalline oxide with the evolution of carbon dioxide. The temperature of the tube furnace rises from RT at the bottom to the firing temperature in the middle with a Gaussian looking profile. The dip coating solution is at ambient.

Single crystal lanthanum aluminate, $LaAlO_3$, has a lattice mismatch to BST of only about 3% and was used as a starting point. Precursor solutions of barium and strontium acetate (the most readily available carboxylates) with the desired cation ratios, were dissolved in water. Then titanium isopropoxide (the most stable alkoxide in solution) was added followed by three parts ethanol for every one part water used. The final concentration was equivalent to 2–5 grams of BST per 100 grams of solution. Up to twenty layers were deposited using firing temperatures ranging from 650 ° C.–750 ° C. Approximately one hundred runs were made and the best results were obtained with parameters in the middle of the indicated ranges. Rocking curves showed in-plane (c-axis) and out-of-plane (ab-axis) mis-orientations of only 0.25° and 0.5°, respectively.

Further experiments, performed after filing the provisional application, found that more optimum process parameters, at least for a $B_{0.5}Sr_{0.5}TiO_3$ composition, were:

| | | Rate (mm/s) | Hold time (seconds) |
|---|---|---|---|
| 1. | Dip and Coat: | 2 | 0 |
| 2. | Remove and Dry: | 1 | 0 |
| 3. | Pull and Fire: | 1 | 300 |
| 4. | Descend and Cool: | 1 | 120 |

Also, the concentration was equivalent to 1.5 grams of BST per 100 grams of solution and the firing temperature was 650° C. (It was hard to differentiate between samples with firing temperatures ranging from 600° C. to 700° C.) The slower rates in steps 1 and 2 mean that the coating will be thicker for each coat and fewer coats are needed to reach a desired thickness. In this case the desired thickness was about 400 nm based on measurements with a stylus profilometer. The thickness is important for commercial devices, but not for proof of principal prototypes. Using the optimized MOCLD method produced a sample with the rocking curve half-width-at-half-maximum of 210° and a calculated c-axis mis-orientation of only about 0.06°.

It should be noted that lanthanum aluminate is used as a process-test substrate because it is commercially available. It was assumed that similar results would be obtained on the YIG substrates with buffer layers that are not commercially available.

Figure 3:
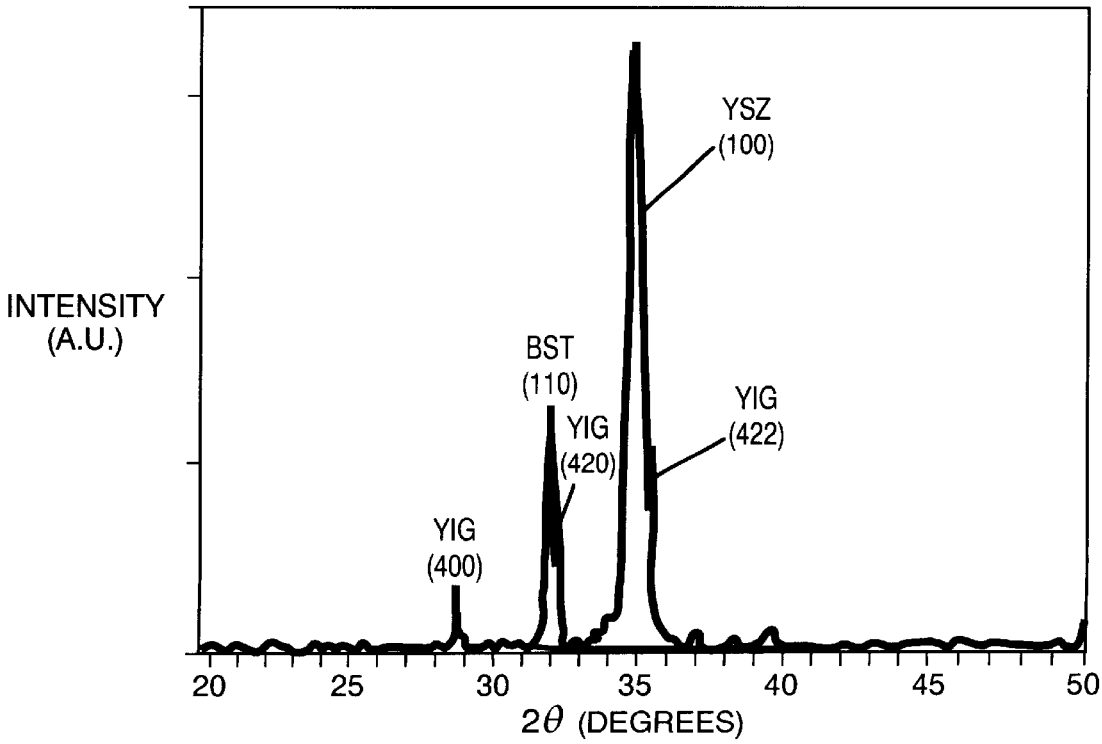
FIG. 3 shows an X-ray diffraction $\theta$-$2\theta$ scan of BST grown on the YSZ of FIG. 2.

FIG. 3 shows an X-ray diffraction θ-2θ scan of the result for $Ba_{0.5}Sr_{0.5}TiO_3$. It is clear that only (110)-oriented $Ba_{0.5}Sr_{0.5}TiO_3$ and (100)-oriented YSZ were grown on the YIG substrate that was polycrystalline with (400), (420), and (422) orientations. The orientation relationship between the BST film by MOCLD and the underlying YSZ buffer layer can be described as $(110)_{BST} \parallel (100)_{YSZ}$.

BST Grown on MgO Deposited on Polycrystalline YIG:

MgO has a cubic rock-salt structure with a lattice parameter of 4.203 Å. It can grow with (100), (110), and (111) orientations. However, it has been found that using the IBAD process with θ=45°, a film with a (100) orientation could be produced on amorphous silicon nitride, C. P. Wang et al., "Deposition of in-plane textured MgO on amorphous $Si_3N_4$ ion-beam-assisted deposition and comparison with ion-beam-assisted deposition of yttria-stabilized zirconia," Appl. Phys. Lett., Vol. 71, No. 20 (Nov. 17, 1997), incorporated herein by reference. The inventors thought that silicon nitride would also be beneficial for growing on YIG because it would smooth out the 50 nm surface roughness. Silicon nitride deposition was accomplished using a standard pulsed laser deposition (PLD) method. The thickness was determined to be about 200 nm. This layer also served as a reference for in-situ process monitoring during the deposition of the MgO.

The IBAD process was then used to grow the MgO layer to a thickness of about 10 nm. The diffraction pattern of the MgO film surface was monitored in real time using reflection high energy electron diffraction (RHEED). A Faraday cup and a quartz crystal monitor were used to measure the ion flux and the evaporation rate of the MgO, respectively. In agreement with the Wang et al. reference, the best in-plane textured (biaxially oriented) MgO buffer layers were obtained with an evaporation rate of 1.5 Å/sec to a total thickness of about 100 nm. The RHEED apparatus also showed that the films became well oriented by the time they were about 10 nm.

After MgO buffer deposition, the substrates were transferred to a PLD system for growth of BST films. The PLD was performed using a 308 nm XeCl excimer laser with an energy density of 2 J/cm$^2$ on a sintered ceramic target. The substrate temperature was 785 ° C. and an oxygen pressure of 200 mTorr was used. Both $Ba_{0.5}Sr_{0.5}TiO_3$ and $Ba_{0.6}Sr_{0.4}TiO_3$ were grown. Resulting film thicknesses were about 500 nm.

Figure 4:
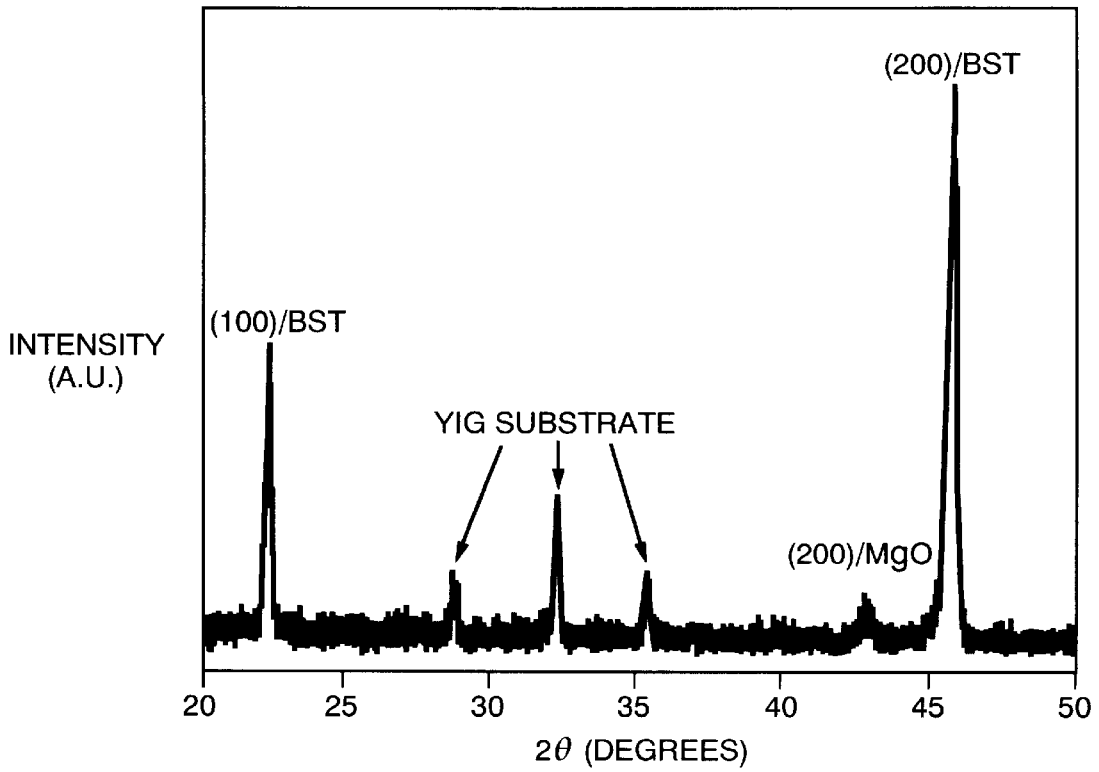
FIG. 4 shows an X-ray diffraction $\theta$-$2\theta$ scan of BST grown on MgO grown on polycrystalline YIG.
Figure 5:
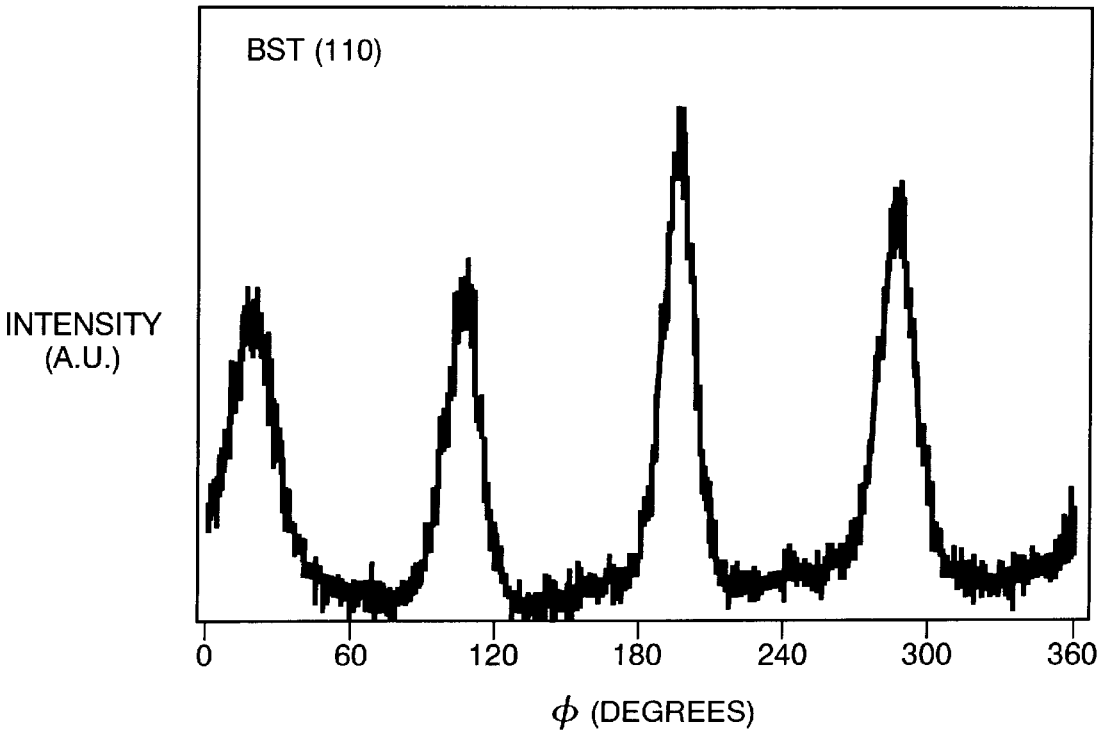
FIG. 5 shows an X-ray diffraction $\phi$ scan on the (110) orientation of BST grown on MgO deposited on polycrystalline YIG.

FIG. 4 shows an X-ray diffraction θ-2θ scan of the result for $Ba_{0.6}Sr_{0.4}TiO_3$. Both the BST and the MgO films were (h00) oriented with respect to the polycrystalline YIG substrate normal. The biaxial orientation nature of BST on polycrystalline YIG can be clearly seen from the X-ray diffraction φ-scan on the (110) BST shown in FIG. 5. The orientation relationship between the BST and the underlying MgO buffer layer can be described as $(100)_{BST} \parallel (100)_{MgO}$. This is different from the relationship between BST and YSZ, but the same as has been observed for $SrTiO_3$ on single crystal MgO substrates. The FWHM of the BST (110) peak was, like BST on YSZ, about 11° even though the MgO lattice match is not as good.

FIGS. 2–5 show that high quality BST ferroelectric films can be successfully grown on polycrystalline YIG ferromagnetic substrates using either a MOCLD process with a YSZ buffer layer or a PLD process using an MgO buffer layer.

Prototype Working Phase Shifters:

FIG. 6 illustrates various cross-sections of possible devices. FIG. 6*a* illustrates a coplanar transmission line on a BST/YSZ/YIG substrate. The center conductor 101 is surrounded by conductors 102 connected as a ground plane. A BST thin film 103, YSZ buffer layer 104 and YIG substrate 106 make up the ferroelectric/ferromagnetic microwave substrate. FIG. 6*b* illustrates a coplanar transmission line on a BST/MgO/$Si_3N_4$/YIG substrate where a $Si_3N_4$ layer 105 was deposited on the YIG substrate 106 before depositing the buffer layer 104, in this case, MgO. The drawings are not to scale, the YIG substrate being many times thicker. To illustrate the major device concept, FIG. 6*c* shows only the tunable ferromagnetic layer 106 and tunable ferroelectric layer 103. FIG. 6*d* illustrates the concept employing a ground plane 109 opposite.

The conductors are preferably a high temperature superconductor (HTSC) such as YBCO, but, with lesser expense and performance, can be made from a metal. Silver and copper have lower resistivities, but gold resists oxidation and is usually preferred.

Figure 7:
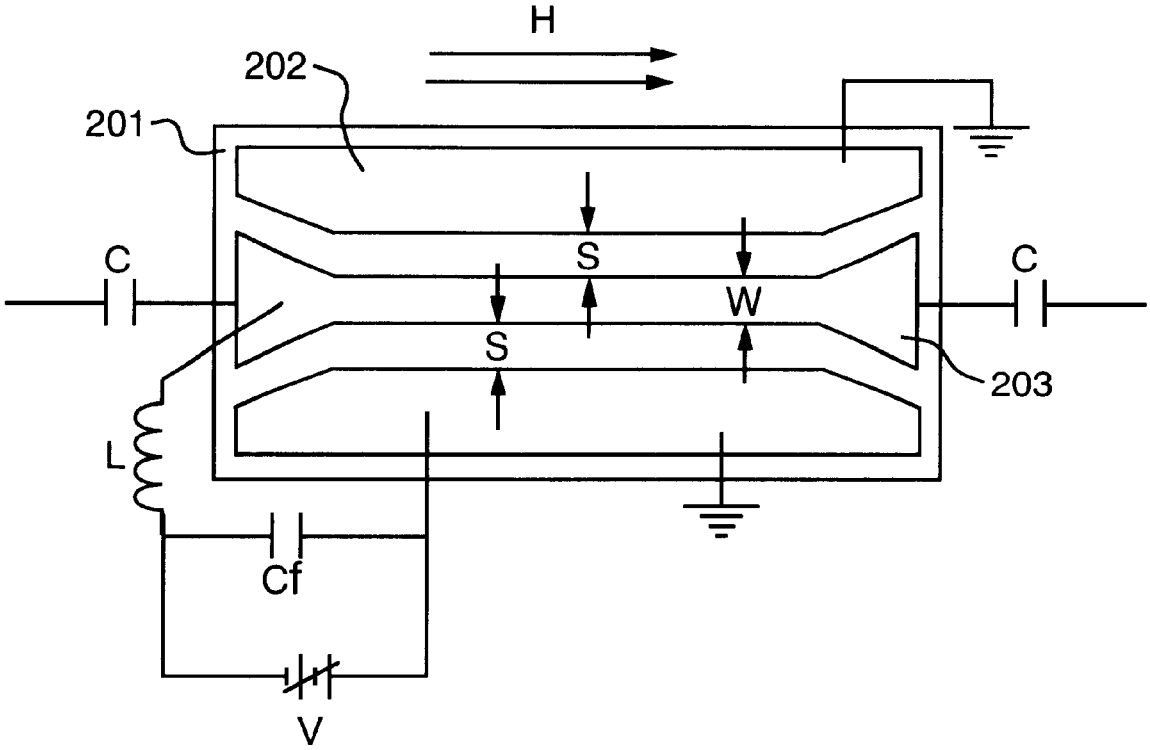
FIG. 7 illustrates the top view of a straight line phase shifter structure.

A prototype working phase shifter was constructed as illustrated by the top view in FIG. 7. The ferroelectric/ferromagnetic substrate 201 was BST/MgO/$Si_3N_4$/YIG (The cross section is similar to that illustrated in FIG. 6*b*) with a BST composition of $Ba_{0.6}Sr_{0.4}TiO_3$. A coplanar ground plane 202 surrounds a center conductor 203. The center conductor was 400 nm thick e-beam a evaporated gold, 6 mm long, and 20 um wide with gaps to the ground plane of 40 um. The mask used was designed for HTSC conductors and therefore the line width was less than optimum for a metal at room temperature. A DC bias voltage V is applied along the underlying ferroelectric BST layer. An RF choke L blocks microwave frequencies and a capacitor Cf provides further filtering. Capacitor C prevents the DC bias voltages from being transmitted out of the phase shifter. Magnetic tuning is obtained with an external magnetic field H oriented along the microwave propagation direction and therefore perpendicular to the magnetic component of the RF field. Note that the device is bidirectional. The device was placed in a standard microwave box with two SMA connectors making contact to the ends of the center conductor and the box was connected to the outer conductors. For this prototype, gold wires and silver paste were used for connections.

Figure 8:
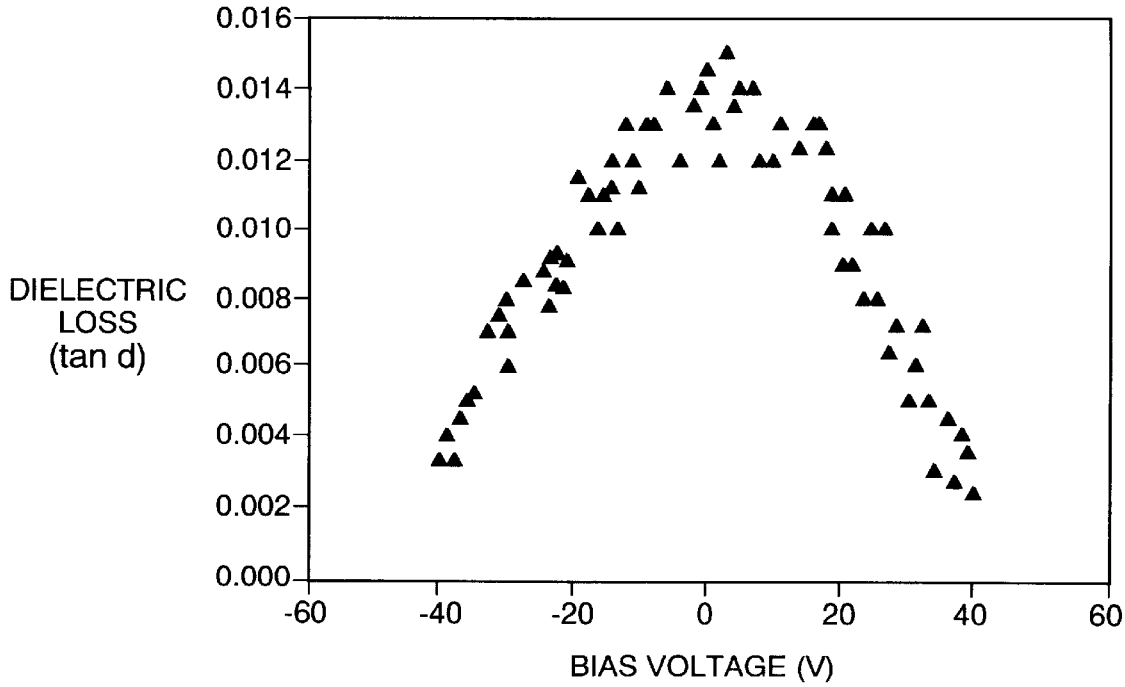
FIG. 8 is a plot of the dielectric losses (tan $\delta$) of a BST film grown on an MgO buffered polycrystalline YIG substrate as a function of applied DC voltage.

FIG. 8 shows a measurement of the dielectric loss (tan δ) as a function of applied DC voltage at 100 kHz. (The line width is due to scatter in the measured results.) Results did not change appreciably from 100 Hz to 10 MHz. The dielectric loss decreased from a value of 0.015 at zero bias to 0.005 at a DC bias voltage of 40 V that corresponds to a maximum DC electric field along the surface of $8\times10^4$ V/cm. In near single crystal epitaxial ferroelectric thin films such as $SrTiO_3$ deposited on lanthanum aluminate, the dielectric loss often decreases with electric field strength, while the loss in less textured or granular $SrTiO_3$ films increases with field strength. This may indicate that this BST film is high quality. In any case, the losses are quite low and wider and thicker gold electrodes or HTSC ones would reduce the losses even further. Equipment was not available to measure tan δ at higher frequencies, but J. D. Baniecki et al., "Dielectric relaxation of $(Ba_{0.7}Sr_{0.3})TiO_3$ thin films from 1 MHz to 20 GHz," Appl. Phys. Lett., Vol. 72, No. 4, pp. 498–500 (Jan. 26, 1998) report that the dielectric loss of a similar composition remains constant from 1 MHz to 20 GHz.

Figure 9:
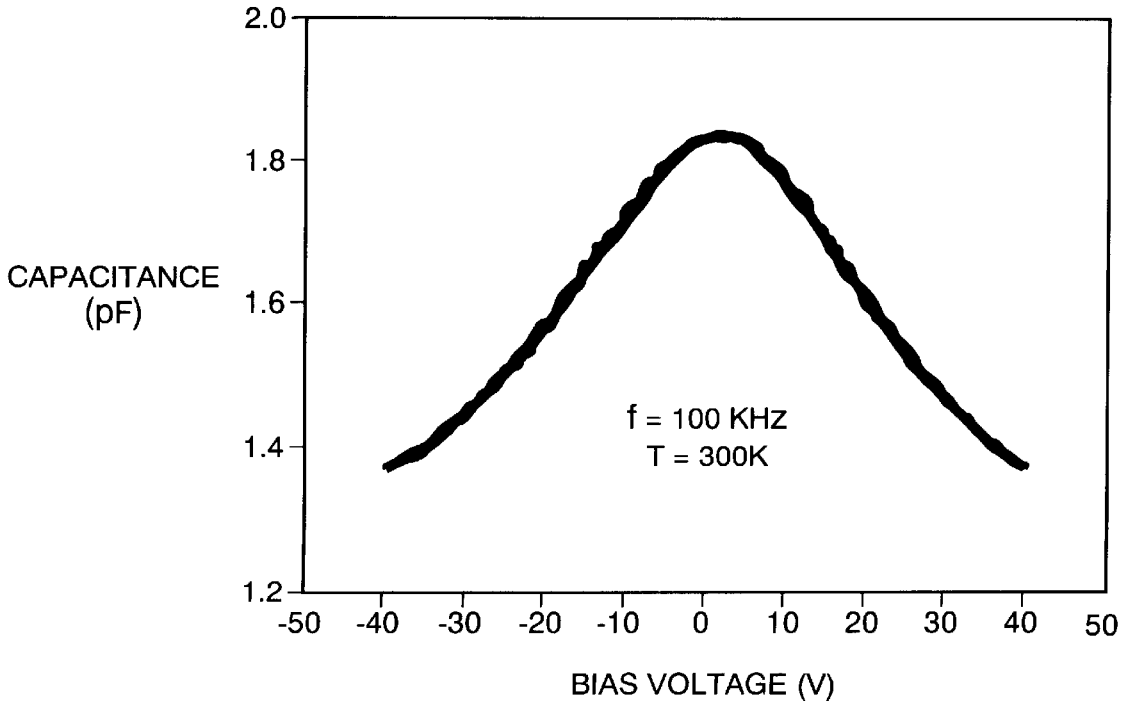
FIG. 9 shows a C-V measurement of a BST film on polycrystalline YIG substrate at 100 kHz.

FIG. 9 shows the results of measuring capacitance as a function of DC bias voltage. The capacitance tunability was about 27% at a dc bias voltage of 40 V. For comparison, the near single crystal BST films grown on the (non-ferromagnetic) lanthanum aluminate had almost identical capacitance tunability. Measurements (not illustrated) of the BST on YIG prototype over a wide temperature range of 77 K to 380 K showed that the losses and capacitance of the device remained nearly constant.

An HP 8510B network analyzer was used to measure the $S_{21}$, and $S_{11}$ parameters of the prototype phase shifter. A laboratory electromagnet was used to apply a magnetic field along the direction of microwave propagation. From Equation 2, the phase shifts of a transmission line due to respective permitivity and permeability changes in the transmission line substrate are:

$$\Delta\phi=180(l/\lambda)(\mu_e/\in_e)^{1/2}\Delta\in_e \qquad \text{Equation (4)}$$

and $$\Delta\phi=180(l/\lambda)(\in_e/\mu_e)^{1/2}\Delta\mu_e \qquad \text{Equation (5)}$$

For small signals, the phase shifts when both ferroelectric and ferromagnetic tuning are used, should be additive.

Figure 10:
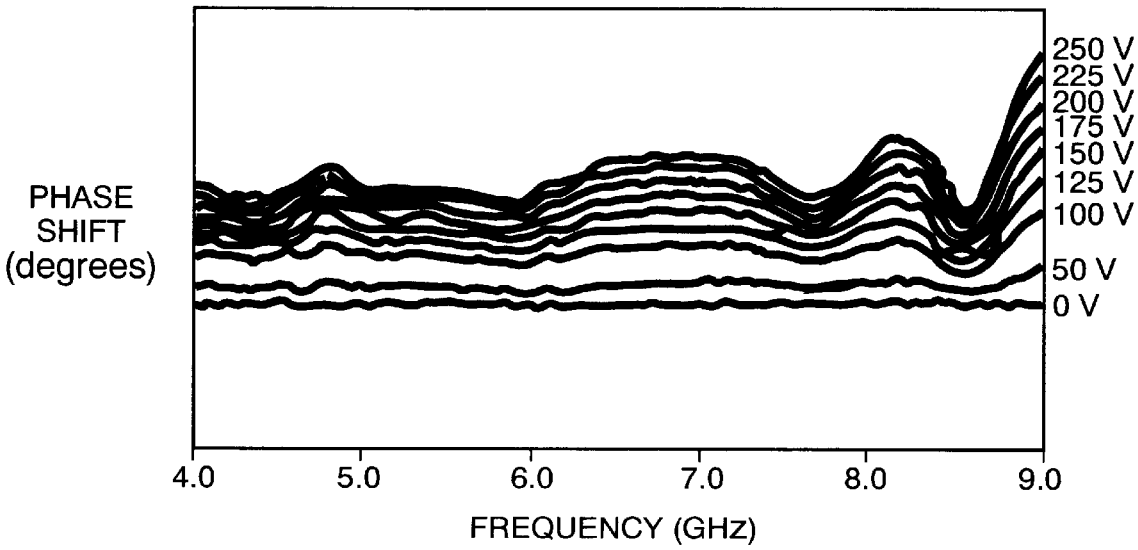
FIG. 10 shows relative phase shifts of a first example dual-tuning phase shifter versus frequency for various voltage biases.
Figure 11:
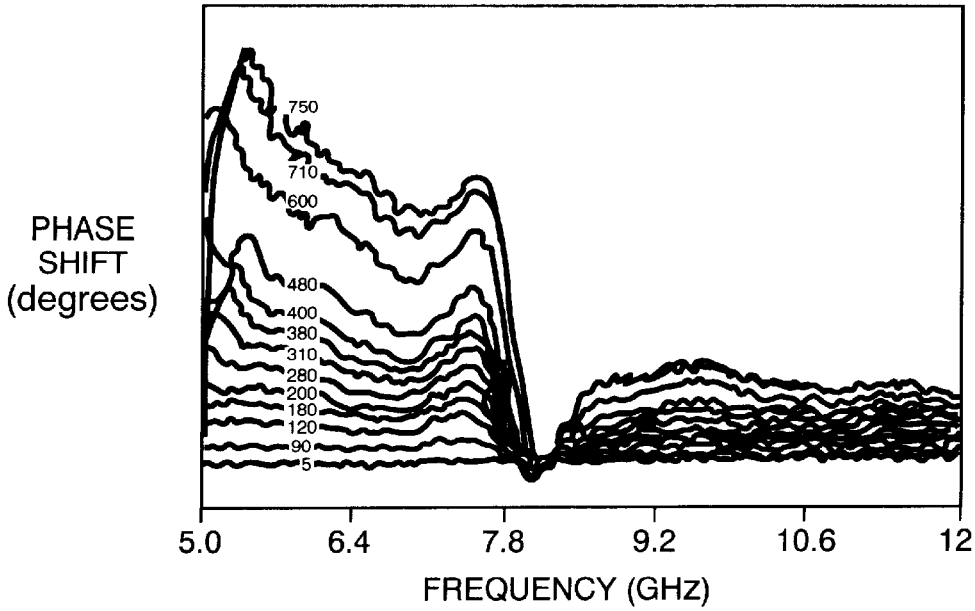
FIG. 11 shows the same as in FIG. 10 for various magnetic fields.
Figure 12:
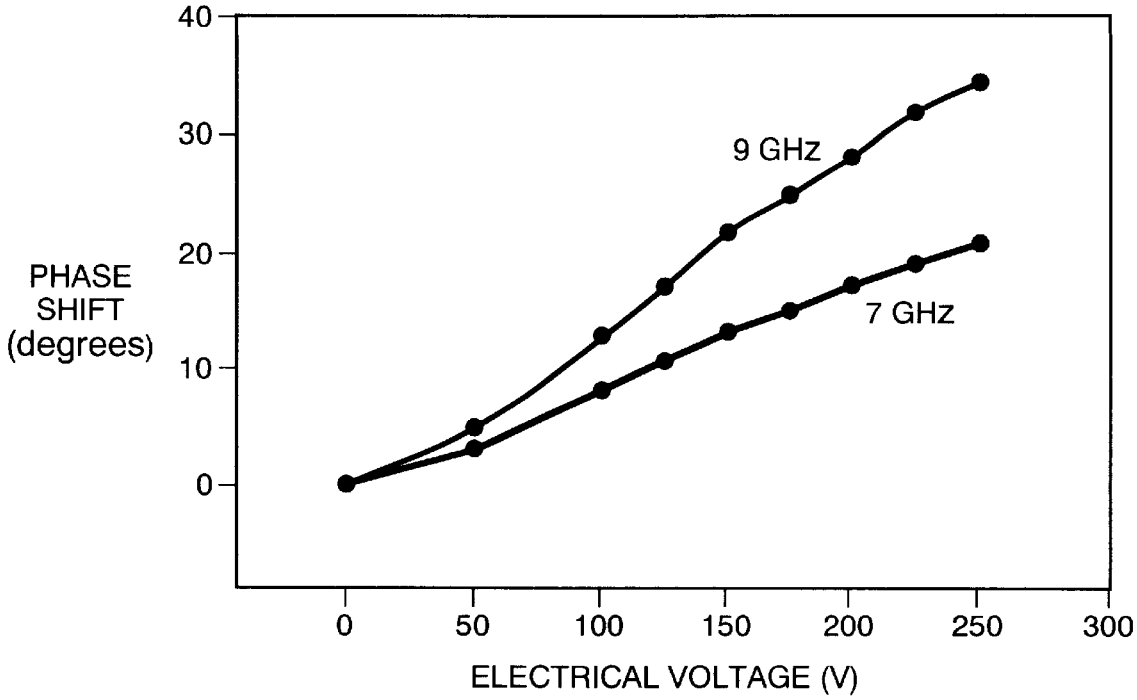
FIG. 12 shows the same as in FIG. 10 at 7 and 9 GHz versus voltage.
Figure 13:
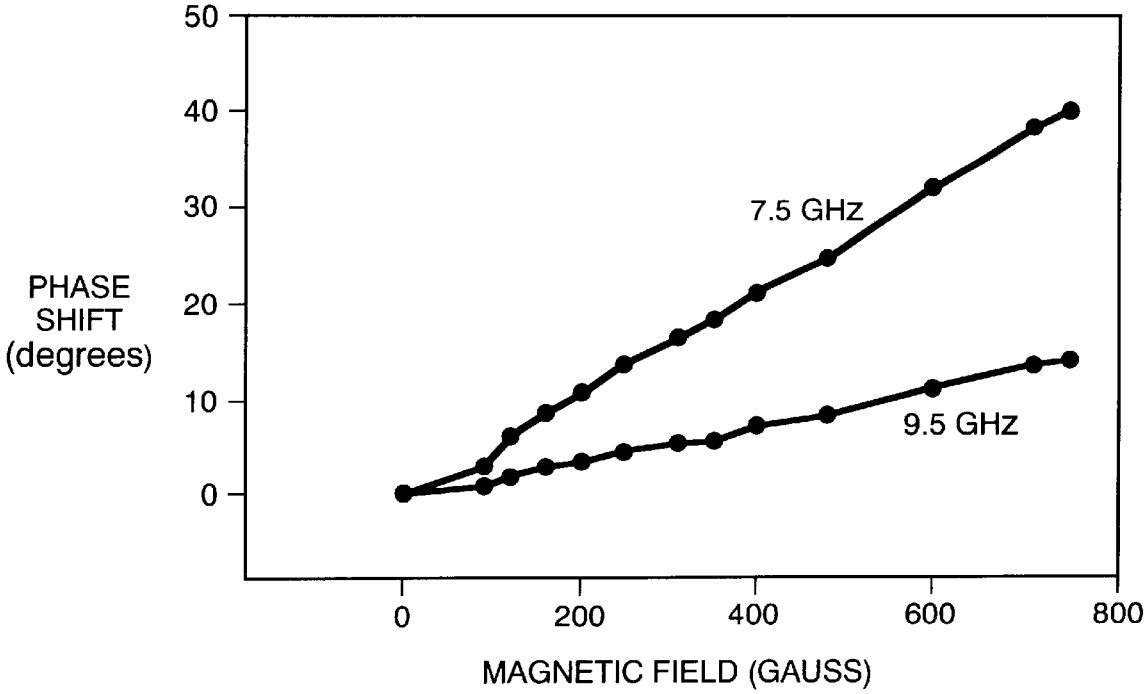
FIG. 13 shows the same as in FIG. 11 at 7 and 9 GHz versus magnetic field.

FIGS. 10 and 11 show relative phase shift spectra between an input and output port under different voltage biases and magnetic fields, respectively. The phase shift with no voltage or magnetic field applied has been subtracted so that the additional phase shift is shown. As can be seen in FIG. 11, magnetic field induced phase shifts were significant in the frequency band 5–7.5 GHz while moderate in the frequency range higher than 8.5 GHz. Below 5 GHz, ferromagnetic resonant (FMR) occurs with external magnetic fields less than 700 G. The highly tunable band width near the FMR can be extended well above 10 GHz by proper device design. Shown in FIGS. 12 and 13 are the phase shifts as a function of electric bias voltage and magnetic field. With a 250V bias, for example, phase shifts of 20° and 34° were achieved at 7 GHz and 9 GHz, respectively.

The magnitude of the transmission ($S_{21}$) and reflection coefficient ($S_{11}$) were measured from 5 to 8 GHz. These are not show because they were a substantially constant −8 dB and −18 dB, respectively. The insertion loss is high, but the effects of connection to the SMA connectors wasn't taken out. Also, the gold center conductor was recoated once and may have had high resistance discontinuities.

Figure 14:
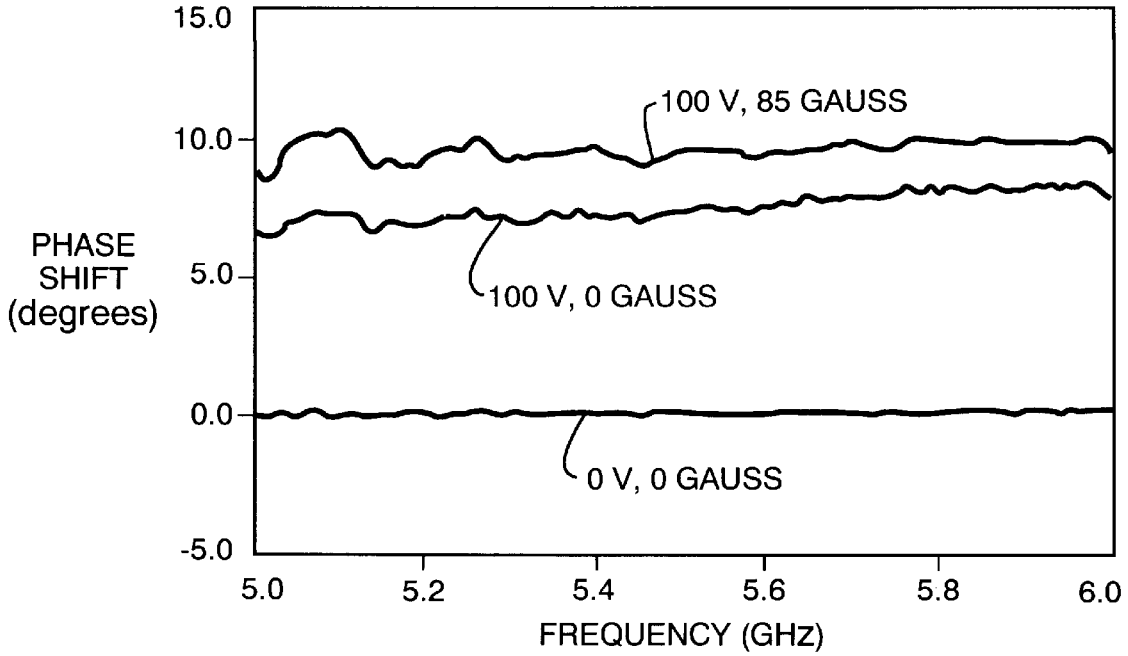
FIG. 14 shows relative phase shifts of a second example dual-tuning phase shifter between 5.0 and 6.0 Ghz with an applied voltage and magnetic field.
Figure 15:
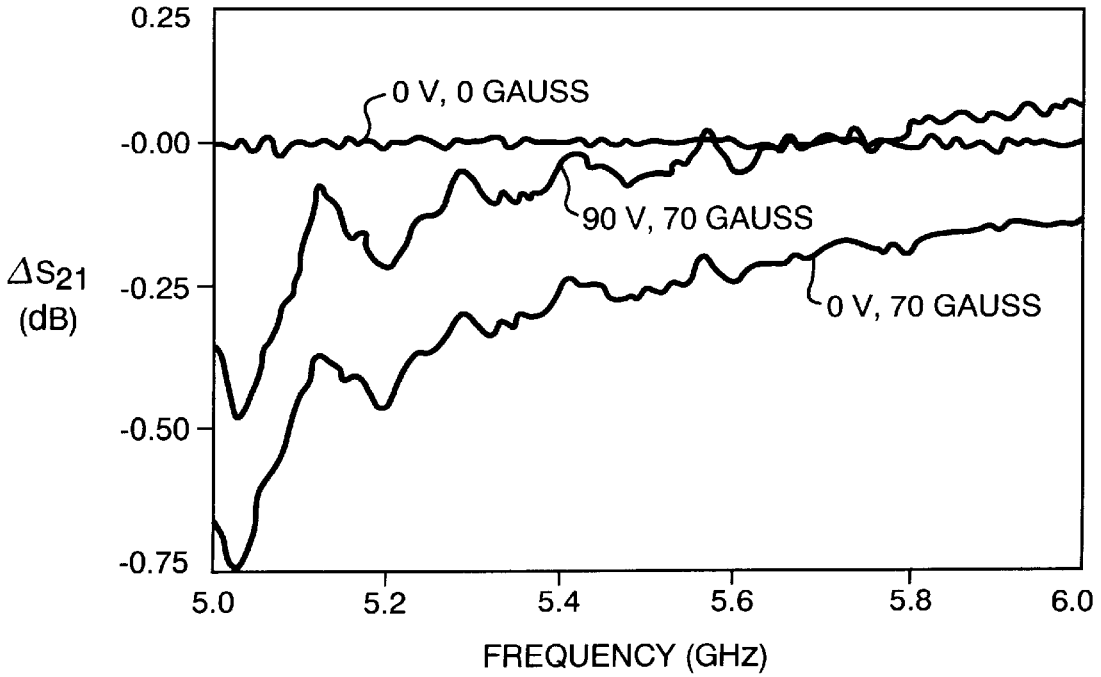
FIG. 15 shows the same as in FIG. 14 with the voltage and magnetic field selected to minimize changes in transmission line impedance.

A second prototype was constructed as the first, but with a $B_{0.5}Sr_{0.5}TiO_3$ composition and using the more optimum dip coating process. FIG. 14 shows the phase shift from 5 to 6 Ghz for a transmission line of the form illustrated in FIG. 7. FIG. 15 is a measure of the change in transmission coefficient $\Delta S_{21}$ with a magnetic field and an impedance compensating electric field. At 5.7 Ghz, the compensation is nearly perfect. For any desired phase shift, there will always be a combination of electric and magnetic fields that produces it and, at the same time, leaves the line impedance unchanged. Note that, it is not necessary to adjust the voltage and magnetic field to make $\Delta Z=0$. In some devices, it may be desirable to change both the phase and impedance.

Figure 16:
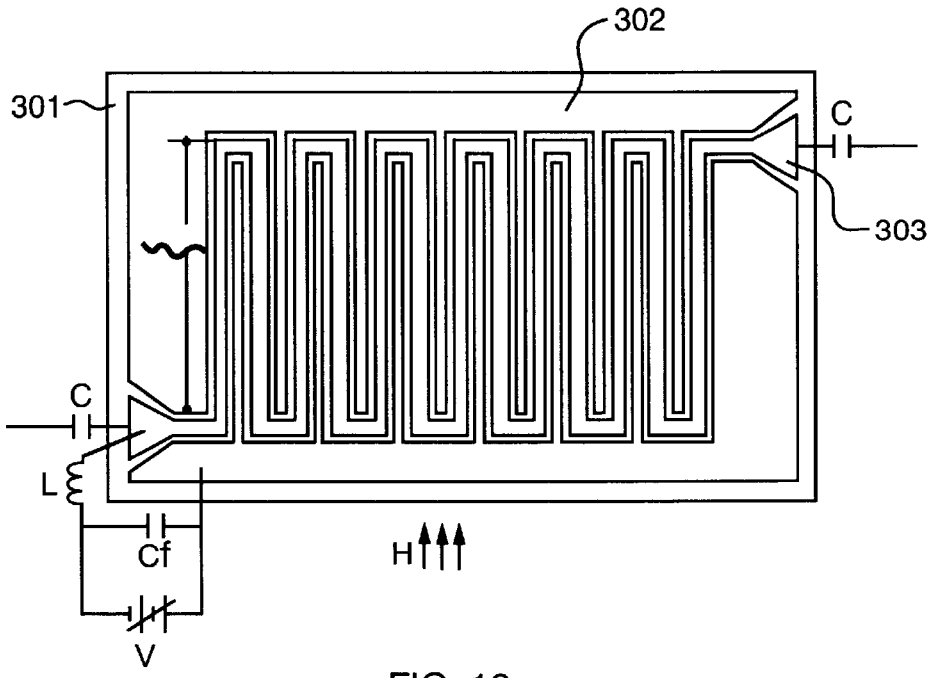
FIG. 16 illustrates a meander line phase shifter structure.

Phase shifts due to the electrical and magnetic tuning are proportional to the length of the transmission line. Considering the relatively short (6 mm) transmission line of the device, both the measured electrical and magnetic tunings were significant. With some sacrifice in bandwidth capabilities, an order of magnitude reduction in bias voltages and magnetic fields could be expected by using the meanderline structure of FIG. 16. The ground plane 302 on substrate 301 is interdigitated and the center conductor 303 follows a meander line path between the fingers. To minimized reflection losses, the length of each segment should be one quarter of the propagation wavelength in the substrate (λg) (or an odd multiple of it). V, L, Cf, and C serve the same functions as in FIG. 7.

Figure 17:
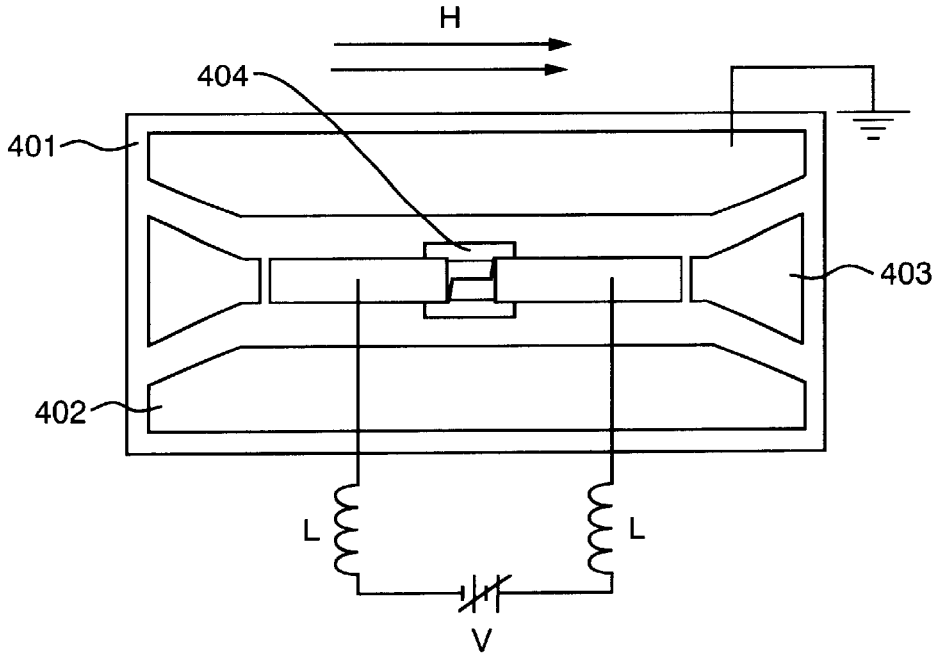
FIG. 17 illustrates a simple resonator.

FIG. 17 illustrates a simple resonator design that can be used as a frequency filter. A ground plane 402 covers the substrate 401 with a center conductor 403. The center conductor has perpendicular coupling gaps at the input and output and a square S-shaped gap in the middle. To minimize RF losses, the gap size should be as small as small as possible (about 5–10 μm) and located a distance $\lambda_g/4$ (or an odd multiple) from the coupling gaps. The ferroelectric layer 404 is only applied under the middle gap region. V, L, and Cf serve the same functions as in FIG. 7. Because of the coupling gaps, no input/output capacitors are needed.

Figure 6A:
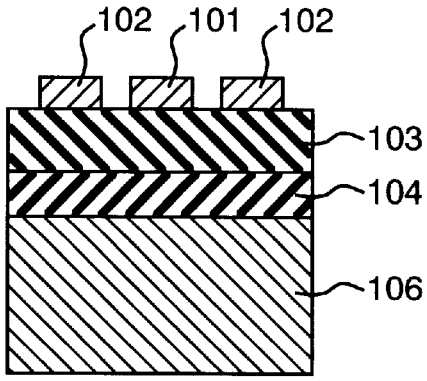
FIG. 6*a* illustrates a coplanar transmission line deposited on a ferroelectric/ferromagnetic substrate having a single buffer layer between the ferroelectric and ferromagnetic layers.
Figure 6B:
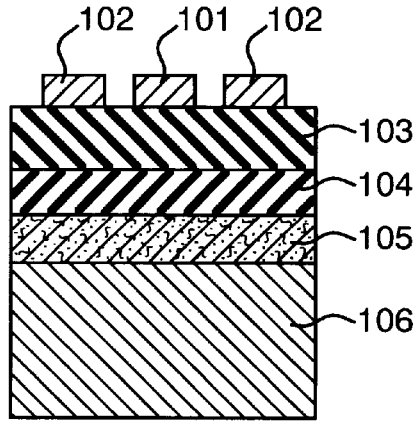
FIG. 6*b* illustrates a structure with two buffer layers.
Figure 6C:
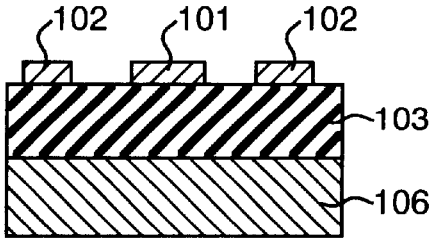
FIG. 6*c* shows only the tunable ferroelectric and ferromagnetic layers.
Figure 6D:
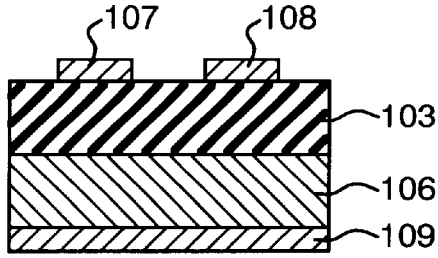
FIG. 6*d* illustrates a slot line having a ground plane on the opposite side of the substrate.
Figure 18A:
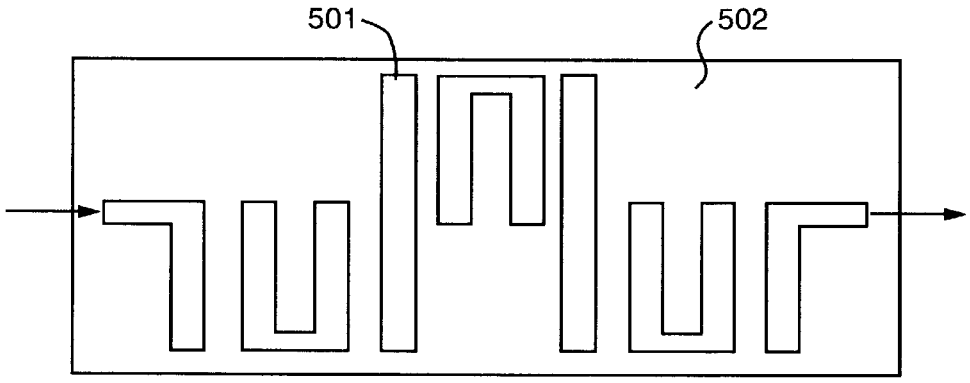
FIG. 18*a* illustrates an electrode geometry for a frequency filter using mixed coupling.
Figure 18B:
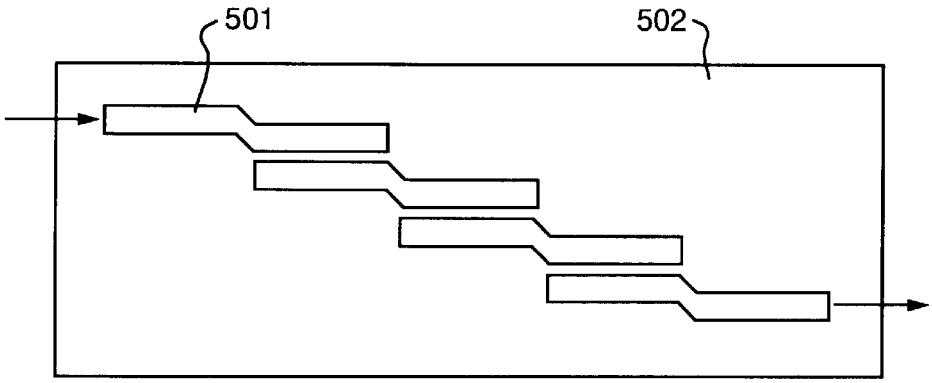
FIG. 18*b* illustrates an electrode geometry for a frequency filter using straight line coupling.
Figure 18C:
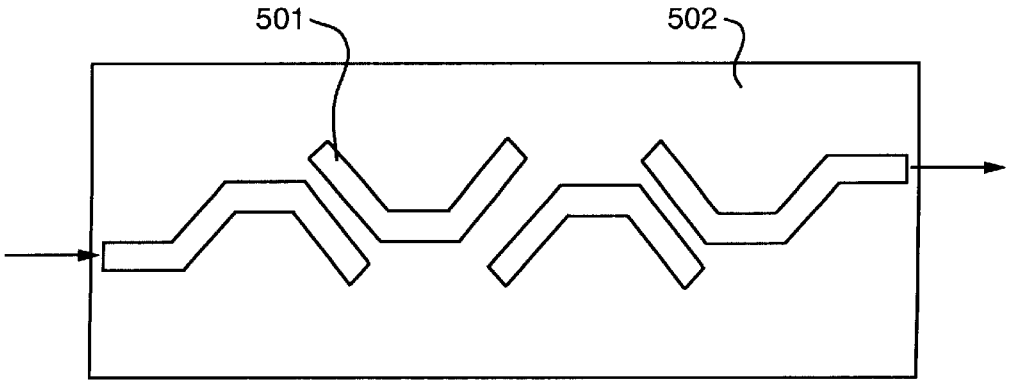
FIG. 18*c* illustrates an electrode geometry for a frequency filter using angled coupling.

FIGS. 18*a–c* illustrate top views of well known filter designs with a cross section as illustrated in FIG. 6*c*. The ferroelectric/ferromagnetic substrate 502 has a ground plane (not shown) on the opposite side from the conductors 501.

Ferromagnetic tuning is obtained with an external magnetic field and ferroelectric tuning by applying DC voltages through RF chokes to conductors 501 as illustrated in previous figures. Each design has advantages and disadvantages. For example, the mixed coupling configuration in FIG. 18*a* is compact, but it is relatively difficult to analyze since the coupling occurs inside the forks.

The design of many microwave devices is well established and can be found in, for example, *Microwave Engineering*, 2nd ed., David M. Pozar, John Wiley & Sons, Co. (1998), incorporated herein by reference. The present invention has more layers than a typical microwave device. This should have little effect on inductive calculations, because the permeability of the ferroelectric layers are all essentially unity. However, they will affect capacitive and, hence, impedance calculations because the permitivity is not identical. Fortunately, several computer software programs are available that can aid in making calculations and designing devices, for example, "KCC Micro-Stripes" from Sonnet Software, Inc., Liverpool, N.Y. Using the program would require knowing the thickness and dielectric constant of the various dielectric layers on the YIG.

An alternative method is to find the effective dielectric constant experimentally by using an electrode geometry for which an equation for the capacitance has been determined. Any convenient geometry can be used but here, the electrodes are on the same side, so that a parallel plate geometry cannot. However, Gevrogian et al., "CAD models for multilayered substrate interdigitated capacitors, IEEE Trans. Microwave Theory Tech., vol 44, No. 6, pp. 896–904 (June 1996), incorporated herein by reference, calculated a solution of the capacitance for a structure having interdigitated electrodes on single and multilayer substrates. The multilayer dielectric calculation is complex, but the effective dielectric constant of the multilayers can be found by assuming a single layer with an effective dielectric constant, $\epsilon_m$. An interdigitated electrode geometry similar to that discussed in the reference was deposited on a BST on YIG sample and the capacitance measured. Using the calculated capacitance for this electrode geometry, the $\in_m$ for the BST layer, buffer layers, and YIG substrate was found for several different samples. It was in the range of 40 to 50. The value of $\in_m$ can then be used to design microwave devices using the same or a very similar sample. Since the theoretical calculations are not exact, the calculated $\in_m$ may have some error, so that routine iteration may be required in designing devices. For instance, if a device transmission line impedance is lower than expected, this means that the $\in_m$ was higher than calculated and it should be adjusted upward according to Equation (3).

U.S. Pat. No. 5,472,935, incorporated herein by reference, discloses a number of microwave devices that use a voltage tuned ferroelectric. In general, any such device can use the dual (electric and magnetic) tuning capabilities of the present invention. In some devices, several segments with separately controllable voltage tuning are combined onto one substrate. In that case, the magnetic field could only be conveniently used to tune all segments with separate voltage tuning of individual segments. In some devices, e.g. phase shifters, the magnetic field should be along the propagation direction while in others, e.g., filters, the magnetic field can also be perpendicular.

Other Materials and Compositions:

Having disclosed measurements on two BST-composition devices, some general comments may be appreciated. Theoretically, the operating temperature can be above or below the Curie temperature, Tc. However, it is Know that operation of ferroelectric materials above Tc in the paraelectric regime provides less microwave losses and temperature sensitivity. U.S. Pat. No. 5,355,104, incorporated herein by reference, illustrates relative dielectric constant versus temperature for various compositions of BST. It is believed that this will depend on whether the BST is in the form of a single crystal or thin film and may be affected by the film forming process, but the general trend should be the same in all cases. Also illustrated is the effect of substituting a small amount of calcium for the barium. The phase transition is much broader and so sensitivity to temperature is much less.

Using the MOCLD process with optimized parameters and an additional calcium acetate precursor, a $Ba_{0.25}Sr_{0.35}Ca_{0.4}TiO_3$ film was made on $LaAlO_3$. No claim is made to this composition. A $Ba_{0.75}Sr_{0.25}TiO_3$ with 5% lead doped-film on YSZ buffered YIG was made using the MOCLD process with lead subacetate as an additional precursor. This produced a very good tunable ferroelectric film in that tan δ was 0.008 at 1 MHz with no electric bias, and the tunability was very high. The shape of the C-V curve was very similar to that illustrated in FIG. 9, but an electric field of 10v/um produced a 50% reduction in capacitance versus 30% for the previous examples. For this composition the Tc was near room temperature. The purpose of the lead doping was to raise Tc but avoid using more barium because higher barium concentrations tend to be more lossy. At the time of filing, further measurements had not been made.

Sometimes it is preferable to undergo the complication of cooling microwave devices with liquid nitrogen in order to use HTSCs and minimize losses even further. For use at liquid nitrogen's temperature, 77 K, very low concentrations of barium, e.g., x=0 to 0.1, would be used to produce a Tc in a range of below 77 K. It should not be difficult to make YBCO superconductors on this composition. The lattice matching of YBCO and STO is nearly perfect, within 2.2% for the a-axis and 0.38% for the b-axis. $SrTiO_3$ (STO) is the substrate of choice for those making many sorts of devices that use YBCO.

The dual tuning device is not limited to BST as the ferroelectric and YIG as the ferromagnetic material. The above referenced patent discloses what is well know in the art, namely, that there is a large class of ferroelectric material that might also be used, including $MgCaTiO_3$ (MCT), $ZnSnTiO_3$ (ZST) and BaOPbO—$Nd2O_3$—$TiO_3$ (BPNT). These could be deposited by sol-gel, plasma-spray, sputtering, physical vapor deposition, chemical vapor deposition, pulsed laser deposition, or other techniques. The inventors have also worked with the well know $(Pb_{1-x}La_x)(Zr_y Ti_{1-y})_{1-x/4}O_3$ (PLZT) and $Pb(Mg_{1/3}Nb_{2/3})O_3$—$PbTiO_3$ (PMN—PT) that should be included even though it is believed that the losses would be higher than for BST.

Two other ferrites could also be used as substrates: $Li_{0.5}Fe_{2.5}O_4$ and $BaFe_{12}O_{19}$. Like YIG, these are available as expensive single crystals, but also as polycrystalline plates. The deposition process should be similar to that for YIG. Moreover, it should be possible to deposit these compositions on another substrate. The MOCLD process was used to deposit YIG films on a GGG substrate, but, so far, the results were not as good as for commercial polycrystalline plates.

Figure 19A:
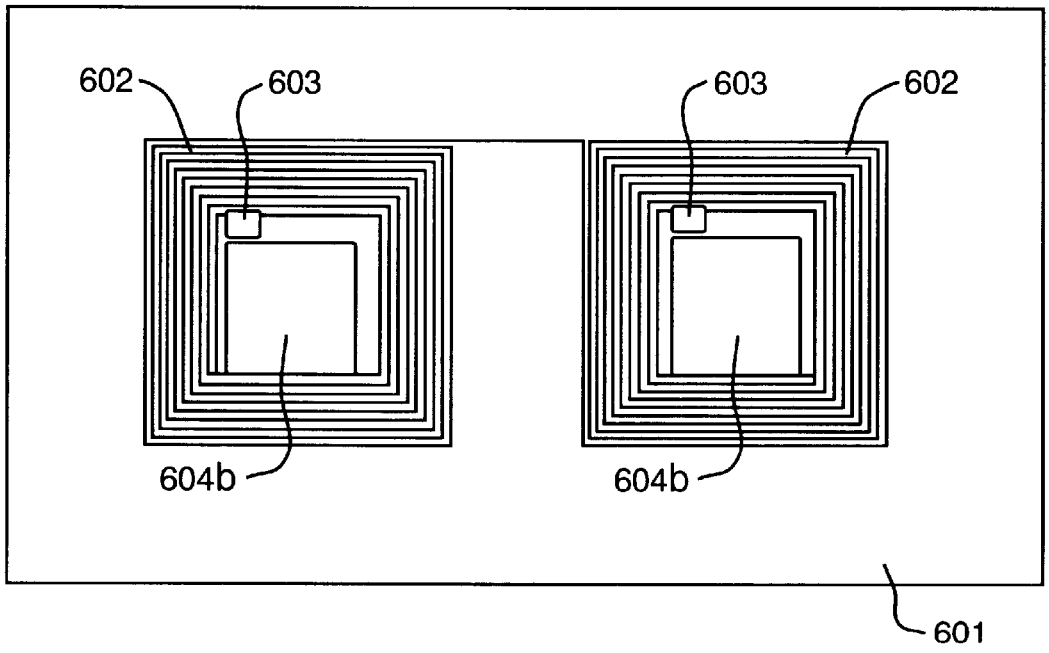
FIG. 19*a* illustrates the top view of a microminiature magnetic field generator.
Figure 19B:
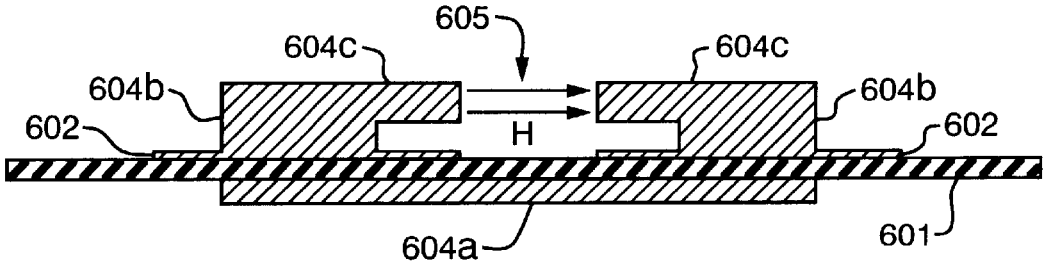
FIG. 19*b* illustrates the center cross-section of the device illustrated in FIG. 19*a*.

Micromagnet:

FIG. 19*a* illustrates a top view and FIG. 19*b* a side view (neither to scale) of a structure that is convenient for applying a magnetic field to the device. This comprises a substrate 601 on which there are deposited two planar coils 602, illustrated schematically only. These are magnetically connected by a high magnetic permeability plate 604*a*, posts

604*b*, and pole pieces 604*c*. Connection to the coils is made at wire-bond contacts 603 shown as dark rectangles in the upper left inside corner of the coils. As illustrated, the current flow directions in the two coils are opposite so that the magnetic field is additive in the magnetic circuit and produces an H field in the region 605.

A prototype was constructed as follows. A commercially available standard silicon wafer with a silicon dioxide coating was obtained. This was coated with a standard photoresist and exposed to form a negative of the coil pattern. Using e-beam evaporation, a 200 Å thick layer of titanium was first deposited to promote adhesion followed by a 2000 Å thick layer of gold. Acetone was used to lift off the unwanted metal. The lift off left coils with 25 turns having about a 20 $\mu$m line width and 20 $\mu$m spacing. In this example, the outer dimension of the coils were 20 mm×10 mm, the space inside the coils was 2 mm×6 mm and between the coils 10 mm×10 mm.

The plate 604*a* was constructed from commercially available sheets of $Ni_{80}Fe_{15}Mo_5$ $\mu$-metal, by using a silver paste adhesive. The posts 604*b* and pole pieces 604*c* were constructed with solid material of the same composition. The faces of the pole pieces were 1 mm×6 mm and separated by 8 mm. It should be noted that the YIG substrate of the devices has a high permeability ($\mu$=134), so that the magnetic reluctance of the gap between pole pieces 604*c* is much lower than air. Ideally, the gap should only be as wide as the YIG substrate.

It was calculated that between the pole pieces the magnetic field would be about 100 Gauss per amp and this was verified experimentally. However, the resistance of the coils was about 2.3 kΩ so that currents higher than about 0.15 amps would require too high a voltage. This can be remedied by using a standard electroless gold plating process to increase the thickness of the coils. Alternately, or in addition, a second coil can be deposited on the side of the substrate 601 opposite the first set of coils 602.

To our knowledge, this is the first time that a microwave device with a dual voltage and magnetic field tuning capability has been demonstrated. Although currently preferred ferroelectric and ferromagnetic materials have been disclosed, the invention includes other obvious variations and equivalents and materials yet to be discovered. The device embodiments disclosed herein illustrate the wide range of microwave devices that can be routinely constructed by those skilled in the art of microwave engineering using the dual tunable ferroelectric/ferromagnetic microwave substrate.

In the claims, "close proximity" means close enough to form a microwave substrate that can be used to make a microwave device. "Microwave substrate" means a substrate on which conductors can be placed or deposited to make a device. "Layer" includes both a plate and a thin film.

What is claimed is:

1. A microwave substrate comprising at least one electrically tunable ferroelectric layer in close proximity to at least one magnetically tunable ferromagnetic layer, wherein said ferromagnetic layer is YIG and said ferroelectric layer comprises essentially BST, wherein said BST has the composition $Ba_xSr_{1-x}TiO_3$ wherein $0 \leqq x \leqq 1$ and x is selected to produce a desired Curie temperature.

2. The substrate of claim 1 wherein said x is in the range of about 0.5 to 0.6 so that the Curie temperature is below room temperature.

3. The substrate of claim 1 wherein said x is in the range of 0.0 to about 0.1 so that the Curie temperature is below liquid nitrogen temperature.

4. A microwave substrate comprising at least one electrically tunable ferroelectric layer in close proximity to at least one magnetically tunable ferromagnetic layer, wherein said ferromagnetic layer is YIG and said ferroelectric layer comprises essentially BST, wherein said YIG layer is in the form of a polycrystalline plate.

5. A microwave substrate comprising at least one electrically tunable ferroelectric layer in close proximity to at least one magnetically tunable ferromagnetic layer, wherein said ferromagnetic layer is YIG and said ferroelectric layer comprises essentially BST, and wherein said YIG layer is in the form of a thick film layer deposited on a plate layer.

6. The substrate of claim 5 wherein said plate layer comprises GGG.

7. The substrate of claim 1 further comprising at least one buffer layer disposed between said ferroelectric layer and said ferromagnetic layer.

8. A microwave substrate comprising at least one electrically tunable ferroelectric layer in close proximity to at least one magnetically tunable ferromagnetic layer, further comprising at least one buffer layer disposed between said ferroelectric layer and said ferromagnetic layer, wherein said at least one buffer layer is comprised essentially of YSZ.

9. The substrate of claim 7 wherein said at least one buffer layer is comprised essentially of a $Si_3N_4$ layer deposited on said ferromagnetic layer and a buffer layer comprised essentially of MgO deposited on said $Si_3N_4$ layer.

10. The microwave device of claim 5 wherein said conductor configuration produces a delay line.

11. The microwave device of claim 5 wherein said conductor configuration produces a resonator.

12. The microwave device of claim 5 wherein said conductor configuration produces a directional coupler.

13. The microwave device of claim 5 wherein said conductor configuration produces a frequency filter.

14. The microwave device of claim 5 wherein said conductor configuration produces at least one element of a phased-array antenna.

15. The substrate of claim 5 wherein said ferroelectric layer further has conductors configured to make a microwave device.

16. The microwave device of claim 15 further comprising a magnetic field generator comprising:

a) at least one planar coil deposited on a coil substrate and having a central region; and b) high permeability material magnetic circuit intersecting said central region and having a gap on at least one side of said coil substrate whereby said microwave device may be placed in said gap.

17. The microwave device of claim 16 further comprising second, third, and fourth planar coils deposited on said coil substrate having a central region encompassed by said magnetic circuit wherein said second coil is deposited on the same side of said substrate as said first coil, said third coil is deposited opposite said first coil, and said fourth coil is deposited opposite said second coil.

18. The microwave substrate of claim 15 having high temperature superconductors configured to make the microwave device.

19. The microwave device of claim 18 wherein said superconductors are comprised of YBCO.

* * * * *